United States Patent [19]

Yoshida et al.

[11] Patent Number: 4,487,613

[45] Date of Patent: Dec. 11, 1984

[54] ODORIZATION OF COMBUSTIBLE HYDROCARBON GASES

[75] Inventors: Takao Yoshida; Ira Katz, both of West Long Branch; Craig B. Warren, Rumson; Charles Wiener, Middletown, all of N.J.

[73] Assignee: International Flavors & Fragrances Inc., New York, N.Y.

[21] Appl. No.: 536,121

[22] Filed: Sep. 26, 1983

[51] Int. Cl.[3] ..... C10J 1/28

[52] U.S. Cl. ..... 48/197 FM; 48/195; 116/214; 252/408.1; 252/964

[58] Field of Search ..... 48/197 FM, 195, 196 FM, 48/199 FM; 252/964, 68, 408.1; 436/3; 44/52, 63, 77; 116/214, 206; 73/40.7

[56] References Cited

U.S. PATENT DOCUMENTS

| | | | |
|---|---|---|---|
| 2,032,431 | 3/1936 | Odell | 48/195 |
| 2,068,614 | 1/1937 | Thomas et al. | 48/195 |
| 2,823,104 | 2/1958 | McClure | 48/195 |
| 3,404,971 | 10/1968 | Olund | 48/195 |
| 3,475,146 | 10/1969 | Olund | 48/196 FM |
| 3,545,949 | 4/1968 | Oister | 48/195 |
| 3,752,659 | 8/1973 | Crouch et al. | 48/197 FM |

FOREIGN PATENT DOCUMENTS

| | | | |
|---|---|---|---|
| 4127404 | 10/1979 | Japan | 48/195 |
| 654668 | 3/1979 | U.S.S.R. | 48/195 |

*Primary Examiner*—Jay H. Woo
*Assistant Examiner*—Joye L. Woodard
*Attorney, Agent, or Firm*—Arthur L. Liberman

[57] ABSTRACT

Described is a warning agent for the odorization of gaseous hydrocarbon fuels based on mixtures of at least one of the compounds, 2-methoxy-3-isobutyl pyrazine having the structure:

and 4-methyl-4-mercapto-2-pentanone having the structure:

with a monomercaptan or a sulfide.

11 Claims, 4 Drawing Figures

ODORIZATION OF COMBUSTIBLE HYDROCARBON GASES

BACKGROUND OF THE INVENTION

The present invention relates to mixtures of 4-methyl-4-mercapto-2-pentanone or 2-methoxy-3-isobutyl pyrazine or combinations thereof in further admixture with other organic sulfur compounds suitable for the odorization of combustible hydrocarbon gases such as natural gas, vapors and gases recoverable in the refining of petroleum and other gases suitable as fuels for heating, illuminating and cooking purposes.

A number of organic sulfur compounds are known in the prior art to be effective malodorants for combustible gases. These include monomercaptans and acyclic and cyclic sulfides. Specific examples of these compounds in which percentages are by weight are the following: (1) Thiophane herein referred to as "Odorant A". (2) Refinery by-product mercaptans herein after referred to as "Odorant B". These materials are characterized by a boiling point range of about 100°-215° F. and comprise $C_2$-$C_4$ mercaptans. Traces of $C_5$ mercaptans are sometimes present. Typically, this odorant contains 25% ethyl mercaptan, 35% isopropyl mercaptan, 15% n-propyl mercaptan, 20% 2-butyl mercaptan, 3% isobutyl mercaptan and 2% n-butyl mercaptan, although they can be present respectively within ranges of about 1-30; 15-50; 5-25; 10-30; 1-6 and 1-4. (3) Mixed aliphatic sulfides of low molecular weight. One alkyl group may be ethyl and the other group ethyl, propyl or butyl. These compounds often contain a small amount (approximately 5%) of refinery by-product mercaptans, Odorant B, hereinafter referred to as "Odorant C". An amount as high as 10% by-product mercaptans can be present. A further specific example of mixed sulfides is a mixture of diethyl sulfide and ethyl propyl sulfide as disclosed in U.S. Pat. No. 2,823,104, the disclosure of which is incorporated by reference herein. (4) t-Butyl mercaptan. This material as an article of commerce often contains refinery by-product mercaptans (Odorant B), in an amount of 15-50% based on the two materials. A mixture of the two materials hereinafter referred to as "Odorant D" in which the refinery mercaptans are present in an amount of about 20%, the mixture having a boiling point range of about 132°-185° F. is a preferred example in commerce. (5) A mixture of dimethyl sulfide and refinery by-product mercaptans (Odorant B) in proportions, for example, of 90% dimethyl sulfide and 10% mercaptans hereinafter referred to as "Odorant E". As little as 5% to as high as 60% mercaptans may be present. (6) A mixture of 1,2-ethane dimercaptan together with at least one of Odorants A, B, C, D or E, hereinafter referred to as "Odorant F" as more particularly described in U.S. Pat. No. 3,404,971 issued on Oct. 8, 1968, the disclosure of which is incorporated by reference herein. Preferably about 5-20% of the ethane dimercaptan is incorporated into the mixture and the resulting mixture is used in a dosage of about 0.3 pounds per million cubic feet (m.c.f.) of hydrocarbon gas. This is indicated to have the same odor intensity as thiophane alone used at a dosage level of 1 pound per m.c.f. of the same hydrocarbon gas.

In addition, U.S. Pat. No. 3,545,949 issued on Dec. 8, 1970 discloses the use of cyclohexyl mercaptan as a gas odorant.

Japan Kokai 73/79804 discloses as an odorizing agent for gases a mixture of valeric acid and ethyl acrylate. It is also indicated in Kokai 73/79804 that this mixture may also contain triethyl amine. Kokai 73/79804 is abstracted in Chem. Abstracts 1974, Number 72614c.

A mixture of ethyl acrylate and t-butyl mercaptan is disclosed to be useful in Japan Kokai 73/79805 abstracted in Chem. Abstracts 1973, number 72615d.

Chem. Abstracts Volume 91, 1979, 60005u (abstract of U.S.S.R. Pat. No. 654668, of Mar. 30, 1979) discloses an odorant of decreased solubility in water and decreased toxicity containing ethyl mercaptan, n-propyl mercaptan, s-butyl mercaptan, isobutyl mercaptan, and n-butyl mercaptan.

German Offenlegungsschrift 2337782 of Feb. 13, 1975 abstracted in Chem. Abstracts 1975, number 45671z, discloses odorization of liquified natural gas by the addition of about 10 volume percent of ethane thiol or methane thiol solutions in propane.

United Kingdom Patent Specification No. 1429982 of Mar. 31, 1976 discloses odorization of natural gas by introducing into it ethyl mercaptan or methyl mercaptan. This U.K. Patent Specification is abstracted at Volume 85, 1976, Number 96766h of Chem. Abstracts.

German Offenlegungsschrift 2347906 of Apr. 11 1974 abstracted at Volume 81, 1974, Chem. Abstracts number 66119z discloses odorization of liquified natural gas with tetrahydro-2-methyl and/or 3-methyl thiophene dissolved in propane at −51° to −29° C.

Romanian Pat. No. 61082 of June 30, 1976 abstracted at Chem. Abstracts Volume 89, 1978, number 46081t, discloses the use of an odorant containing dimethyl sulfide, methyl mercaptan, ethyl mercaptan and diethyl sulfide with carbon monoxide, carbon dioxide, hydrogen and methane for odorizing natural gases.

Japan Kokai 79/58702 of May 11, 1979 abstracted at Volume 91, Chem. Abstracts, number 177874t discloses the odorization of liquified natural gas or city gas with stable t-heptyl mercaptan.

Japan Kokai 79/58701 of May 11, 1979 abstracted at Chem. Abstracts, Volume 91, number 195745f, discloses odorization of liquified natural gas or city gas with cyclohexane containing an organic sulfide or thiol such as ethyl mercaptan, isopropyl mercaptan, t-butyl mercaptan, dimethyl sulfide or methyl ethyl sulfide.

Japan Kokai 80/149392 of Nov. 20, 1980 abstracted at Volume 94, 1981, Chem. Abstracts number 124379r, discloses odorization of fuel gases such as natural gas, with a gaseous mixture of dimethyl sulfide, t-butyl mercaptan and isopropyl mercaptan.

Nothing in the prior art, however, discloses the unexpected, unobvious and advantageous effect of the mixture of 4-methyl-4-mercapto-2-pentanone and/or 2-methoxy-3-isobutyl pyrazine taken further together with other organic mercaptans or sulfides.

Although U.S. Pat. No. 3,630,750 discloses the use of 2-methoxy-3-isobutyl pyrazine in augmenting or enhancing the aroma of foodstuffs, particularly by imparting or augmenting an intense aroma of freshly chopped green bell peppers, and U.S. Pat. No. 3,773,524 discloses the use of keto mercaptans in augmenting or enhancing meat flavors, and 4-methyl-4-mercapto-2-pentanone, itself, is shown to cause an off flavor in cheese by Badings, J. Dairy Science, 50, Number 9, pages 1347 et seq. 1967, this prior art concerning augmenting or enhancing the organoleptic properties of consumable foodstuffs is not applicable to the art involving odorization of hydrocarbon gases used commercially.

SUMMARY OF THE INVENTION

Figure 1:
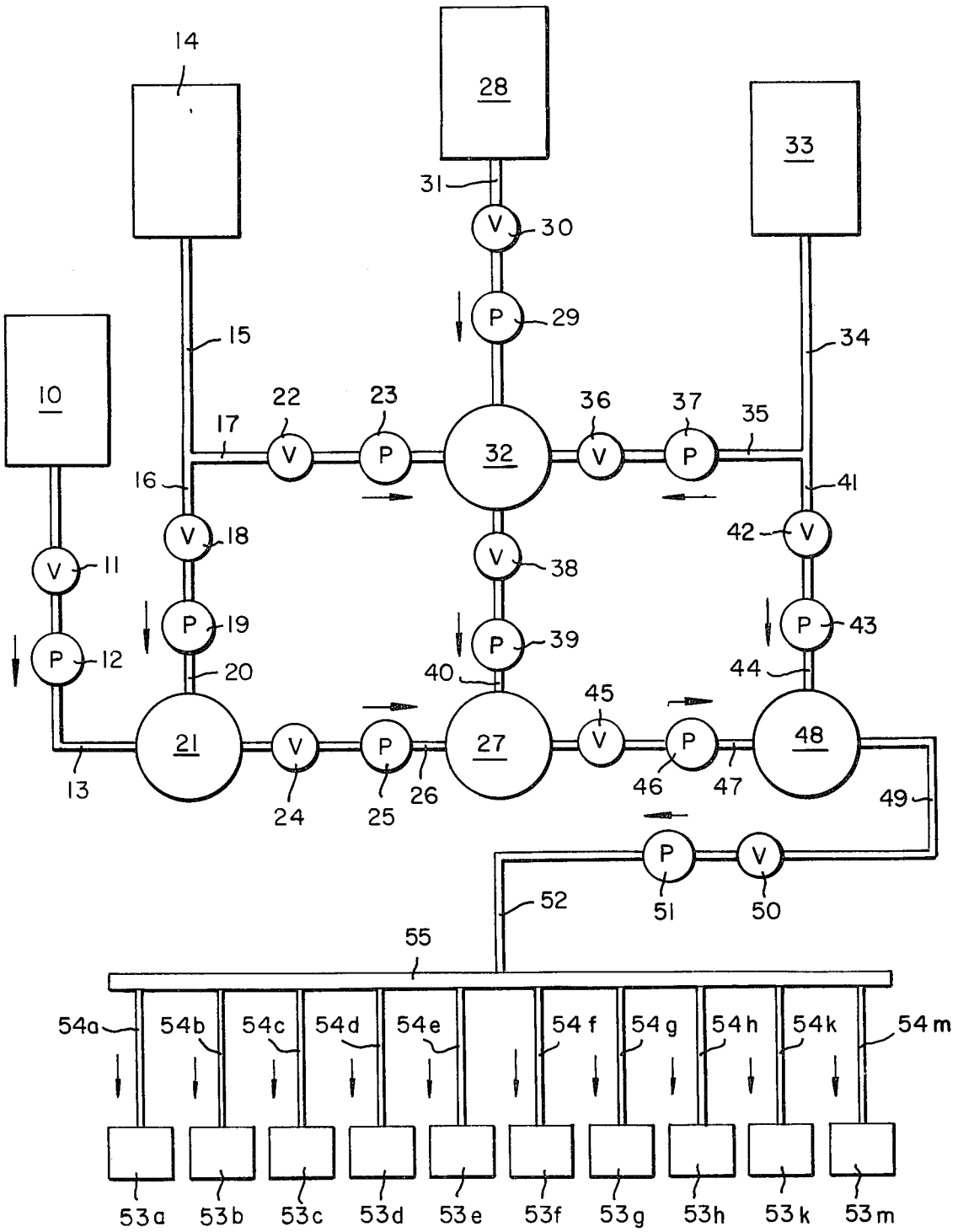
FIG. 1 is a schematic diagram showing a flow chart whereby the odorants of our invention are admixed with a hydrocarbon gas stream and the resulting fluid is then distributed.

Natural gas is usually odorized with mercaptans, alkyl sulfides, cyclic sulfides or various blends of two or more of these materials. However, when the properties of these materials are compared with those of a theoretically ideal odorant, all will be found to be deficient in one or more areas. Some of the recognized features of an ideal odorant would be high odor strength, high odor impact, high stability under pipeline conditions, moderate volatility, low corrosivity and low toxicity. Of the above features, odor strength (basically odor detectability of the material at low concentrations) and odor impact (the ability of a particular odor to arrest attention) are probably of primary importance because these are the features which allow the detection of gas before it reaches hazardous concentrations. It is generally recognized that of the above materials, the mercaptans offer the highest odor intensity and the highest odor impact. However, it is also known that under certain pipeline conditions mercaptans are not stable because they are readily oxidized to essentially non-odorous materials. The alkyl sulfides and cyclic sulfides offer greater stability than mercaptans and have odor intensities similar to mercaptans, but generally have been less widely accepted because they lack the odor impact offered by mercaptans.

Furthermore, U.S. Pat. No. 3,545,949 teaches that of the mercaptans, t-butyl mercaptan has been preferred to be used commercially as a gas odorant because it is the least susceptible of the lower alkyl mercaptans to oxidation and consequently is the base for the majority of the gas odorants used today. U.S. Pat. No. 3,545,949 further teaches that n-hexyl mercaptan and cyclohexyl mercaptan overcome a number of problems theretofore existing in the field of odorization of natural gas.

Furthermore, in U.S. Pat. No. 3,404,971 it was found that odor intensity of conventional malodorants can be increased by incorporation in them of a small amount of ethane dimercaptan ranging from about 1% up to about 20% by weight based on ethane dimercaptan and malodorant and used in a dosage of about 0.3 pounds per million cubic feet of hydrocarbon gas.

It has now been found that the odor intensity of all of the foregoing conventional and prior art malodorants can be increased by incorporation in them of a small amount of 4-methyl-4-mercapto-2-pentanone and/or 2-methoxy-3-isobutyl pyrazine, the amount of 4-methyl-4-mercapto-2-pentanone in the odorant can range from about 10% up to about 30%; preferably about 20% by weight based on total malodorant. For example, a mixture of 20% 4-methyl-4-mercapto-2-pentanone and 80% thiophane used in a dosage of 0.3 pounds per million cubic feet (m.c.f.) of hydrocarbon gas has the same odor intensity as thiophane alone used at a dosage level of 2 pounds per million cubic feet of the same hydrocarbon gas indicating a six-fold improvement. In addition, when using 4-methyl-4-mercapto-2-pentanone or 2-methoxy-3-isobutyl pyrazine, the odorant approaches ideality:

high odor strength;
high odor impact;
high stability under pipeline conditions;
moderate volatility;
low corrosivity; and
low toxicity.

Indeed, 4-methyl-4-mercapto-2-pentanone is used as a food flavorant as set forth supra.

When using a mixture of 4-methyl-4-mercapto-2-pentanone and 2-methoxy-3-isobutyl pyrazine, the amount of mixture of 4-methyl-4-mercapto-2-pentanone and 2-methoxy-3-isobutyl pyrazine may range from about 1 up to about 25% depending upon the proportion of 2-methoxy-3-isobutyl pyrazine in the 4-methyl-4-mercapto-2-pentanone. Thus, when 95% 2-methyl-3-isobutyl pyrazine is used, the amount of mixture of 2-methoxy-3-isobutyl pyrazine and 4-methyl-4-mercapto-2-pentanone in the odorant can be as low as 1% and even lower (0.5%). When using a mixture containing 50% 4-methyl-4-mercapto-2-pentanone and 50% 2-methoxy-3-isobutyl pyrazine, the range may be from about 2% up to about 25% with a preferred range of from about 2 up to about 5% in the base odorant.

When using only 2-methoxy-3-isobutyl pyrazine in the base odorant without the 4-methyl-4-mercapto-2-pentanone, the range of 2-methoxy-3-isobutyl pyrazine in the base odorant may vary from about 0.4% up to about 3%.

It is preferred to use mixtures of 4-methyl-4-mercapto-2-pentanone and 2-methoxy-3-isobutyl pyrazine ranging from about 1% 2-methoxy-3-isobutyl pyrazine and 99% 4-methoxy-4-mercapto-2-pentanone up to about 50% 2-methoxy-3-isobutyl pyrazine and 50% 4-methyl-4-mercapto-2-pentanone with a range of mixture in the base odorant of from about 0.6% up to about 20%.

The dosage of base odorant in the hydrocarbon gas may vary from about 0.05 pounds per million cubic feet up to about 1 pound per million cubic feet with a preferred range of from about 0.1 up to about 0.3 pounds per million cubic feet.

The method of mixing the conventional or base odorant and the odorant boosting B 4-methyl-4-mercapto-2-pentanone and/or 2-methoxy-3-isobutyl pyrazine is not critical. Since these materials are relatively low boiling liquids, one or the other can be added to the other in the indicated proportion ranges in a manner applicable to the mixing of any compatible liquids. However, it is advisable to utilize mixing apparatus as set forth in the detailed description of the drawings, infra, or apparatus as disclosed in U.S. Pat. No. 3,907,515 issued on Sept. 23, 1975 or U.S. Pat. No. 4,025,315 issued on May 24, 1977, the disclosures of which are incorporated by reference herein.

To show the odor boosting effectiveness of the odorant mixture of the present invention containing 4-methyl-4-mercapto-2-pentanone and/or 2-methoxy-3-isobutyl pyrazine, determinations were made according to the so-called "walk-in room test", the test utilized in the following tabulated examples.

According to this test, odor intensity is determined by a panel of at least five persons, preferably ten or more according to the scale hereinbelow set forth.

A room with a volume of approximately 1,500 cubic feet is used. The room has facilities for ventilation between tests and is free from any significant air movement during the tests. No odor other than that of the warning agent being tested in present during the test.

A 3.2 ml ethanolic solution of the odorant is then vaporized into the room, the vaporization taking not more than 5 minutes to occur. The odorant concentration in the 3.2 ml solution is such as to give a concentration equivalent to that obtained from odorized gas (methane) diluted to 1% gas in air. Thus at a concentration corresponding to 1 pound odorant per 1 million cubic feet gas and 1 volume percent gas concentration in the room, the ethanol solution will contain 2.13 grams odorant per liter of solution.

The person vaporizing the odorant does not participate in rating the samples to be tested and at least 15 minutes is allowed between each test to allow the olfactory nerve to recover. After vaporization into the room, a five member or larger odor panel rates odor intensity of the composition according to the following scale:

| Odor intensity: | Rating |
|---|---|
| No odor | 0 |
| Barely noticeable | 1 |
| Easily noticeable | 2 |
| Strong | 3 |

The odor intensity is judged immediately after entering the room. Any unusual character of the odor is noted and recorded. The average ratings are then calculated, rounded off to the nearest one/tenth. Finally, the results are interpreted using the above scale.

Tabulated below are given average panel results determined as described above. The odor intensities of the various odorants alone or of odorant compositions containing the indicated proportions of 4-methyl-4-mercapto-2-pentanone and/or 2-methoxy-3-isobutyl pyrazine are given. The odor intensity determinations were made using four mixtures as set forth below and denoted as mixtures "A", "B", "C", "D", "E", "F" and "G":

| FORMULAS | |
|---|---|
| Ingredients | Parts by Weight |
| Formula "A" | |
| Ethyl mercaptan | 500.0 |
| Dimethyl sulfide | 200.0 |
| Methyl acrylate | 100.0 |
| n-Butanal | 50.0 |
| Acetaldehyde | 30.0 |
| 2-Methoxy-3-isobutyl pyrazine | 0.5 |
| Thiophane | 100.0 |
| Formula "B" | |
| Ethyl mercaptan | 350.0 |
| t-Butyl mercaptan | 225.0 |
| Dimethyl sulfide | 75.0 |
| Methyl acrylate | 100.0 |
| n-Butanal | 100.0 |
| Acetaldehyde | 149.5 |
| 2-Methoxy-3-isobutyl pyrazine | 0.5 |
| Formula "C" | |
| Ethyl mercaptan | 350.0 |

-continued

| FORMULAS | |
|---|---|
| Ingredients | Parts by Weight |
| t-Butyl mercaptan | 225.0 |
| Dimethyl sulfide | 75.0 |
| Methyl acrylate | 90.0 |
| n-Butanal | 100.0 |
| Acetaldehyde | 150.0 |
| Skatole | 10.0 |
| Formula "D" | |
| Ethyl mercaptan | 500.0 |
| t-Butyl mercaptan | 399.5 |
| 4-methyl-4-mercapto-2-pentanone | 100.0 |
| 2-methoxy-3-isobutyl pyrazine | 0.5 |
| Formula "E" | |
| Ethyl mercaptan | 550.0 |
| t-Butyl mercaptan | 399.5 |
| 4-methyl-4-mercapto-2-pentanone | 50.0 |
| 2-methoxy-3-isobutyl pyrazine | 0.5 |
| Formula "F" | |
| Ethyl mercaptan | 590.0 |
| t-Butyl mercaptan | 399.5 |
| 4-methyl-4-mercapto-2-pentanone | 10.0 |
| 2-methoxy-3-isobutyl pyrazine | 0.5 |
| Formula "G" | |
| Ethyl mercaptan | 350.0 |
| t-Butyl mercaptan | 225.0 |
| Dimethyl sulfide | 75.0 |
| Methyl acrylate | 90.0 |
| n-Butanal | 100.0 |
| Acetaldehyde | 150.0 |

TABLE I

| Example Number | Formula Code (odorant) | Concentration in Propane Gas (pounds per 10,000 gallons) | Average Rating |
|---|---|---|---|
| I | A | 1.0 | 2.80 |
| II | A | 3.0 | 2.90 |
| III | B | 1.0 | 2.80 |
| IV | B | 3.0 | 2.95 |
| V | C | 1.0 | 1.20 |
| VI | C | 3.0 | 1.70 |
| VII | D | 2.0 | 2.95 |
| VIII | E | 2.5 | 2.90 |
| IX | F | 2.5 | 2.80 |
| X | G | 3.0 | 0.80 |
| XI | G | 1.0 | 0.20 |

On the basis of the testing procedure of Katz, et al (Bureau of Mines Technical Paper 480 "Intensities of Odors and Irritating Effects of Warning Agents from Flammable and Poisonous Gases" (1930)), 4-methyl-4-mercapto-2-pentanone and/or 2-methoxy-3-isobutyl pyrazine at a concentration equivalent to 1 pound in 1 million cubic feet of gas (methane) diluted to 1% in air gives a rating on the same basis of Table I of 2.3. The odor boosting effect of 4-methyl-4-mercapto-2-pentanone and/or 2-methoxy-3-isobutyl pyrazine is clearly evident. The odor intensity of 4-methyl-4-mercapto-2-pentanone and/or 2-methyl-3-isobutyl pyrazine gives rise to unexpected, unobvious and advantageous effects as when compared to ethane dimercaptan or mixtures of ethane dimercaptan and thiophane, e.g. 15% ethane dimercaptan and 85% thiophane. Similar results as shown in the table are obtained with other base odorants of the prior art.

The malodorant mixture herein described is eminently suitable for use in combustible gases such as natural gas used in the home or in industry for cooking or illumination. It possesses a distinctive odor thereby providing a timely warning of escaping gas even though present in small concentration. Although effective, the malodorant of the present invention is not so offensive that the users of the combustible gas object to its presence. Further, it is odorless when completely burned. When partially burned, however, the odor is clearly present showing only partial burning and therefore a potentially toxic environment. The malodor mixture herein described in the amounts used does not cause any objectionable skin irritation, lachrymation or other harmful physiological effects. Finally, with the present malodorant composition, a gradual accumulation of odor intensity does not cause olfactory fatigue to the extent that the other odorants of the prior art do.

DETAILED DESCRIPTION OF THE DRAWINGS

In FIG. 1, a hydrocarbon gas from source or holding tank 10 is pumped through line 13 through valve 11 using pump 12 into mixing center 21 where it can be mixed with an additive such as 4-methyl-4-mercapto-2-pentanone or 2-methoxy-3-isobutyl pyrazine or a mixture of 4-methyl-4-mercapto-2-pentanone and 2-methoxy-3-isobutyl pyrazine from holding tank 14 which is pumped through lines 15 and 16 using pump 19 through valve 18 and through line 20. Control valve 18 can be controlled using electronic data processing depending on the desirable concentration of odorant in hydrocarbon gas emanating at distribution blocks 53*a*, 53*b*, 53*c*, 53*d*, 53*e*, 53*f*, 53*g*, 53*h*, 53*k* and 53*m*.

In the alternative, additives may come from sources 14, 28, and 33 where they can be premixed in premixing means 32. Thus, valves 18 and 42 can be completely closed and 4-methyl-4-mercapto-2-pentanone held in holding tank 14, 2-methoxy-3-isobutyl pyrazine held in holding tank 28 and, for example, t-butyl mercaptan held in holding tank 33 can all be mixed in mixing means 32. Thus, additive from tank 14 passes through line 15 and 17 using pump 23 through valve 22 into mixing means 32. Additive from holding tank 28 is passed through line 31 through valve 30 using pump 29 into mixing means 32. Additive from holding tank 33 is passed through lines 34 and 35 through valve 36 using pump 37 into mixing means 32. The resulting mixed additive from mixing means 32 is then passed through line 40 using pump 38 through valve 39 into mixing means 27 where it is mixed with hydrocarbon gas from source 10 which is passed through valve 11 using pump 12 through line 13 past mixing means 21, through line 26, using pump 25, through valve 24 into mixing means 27. The resulting odorized hydrocarbon gas is then passed through line 47 using pump 46 and control valve 45 and then past mixing means 48 through line 49 using pump 51 and control valve 50 and then through line 52 into manifold 55 and thence into distribution lines 54*a*, 54*b*, 54*c*, 54*d*, 54*e*, 54*f*, 54*g*, 54*h*, 54*k* and 54*m*. Each of these distribution lines respectively leads to distribution blocks or distribution points 53*a*, 53*b*, 53*c*, 53*d*, 53*e*, 53*f*, 53*g*, 53*h*, 53*k* and 53*m*. In the alternative, additives from holding tanks 14 e.g. 4-methyl-4-mercapto-2-pentanone, 33 e.g. 2-methoxy-3-isobutyl pyrazine, and 28 e.g. 1,2-ethane dimercaptan, may be separately mixed with hydrocarbon gas coming from source 10 if valves 22 and 36 are closed and valves 18, 39, 30 and 42 are open. The mixing of the odorant additive from holding tank 14 then takes place at mixing means 21. The mixing of the additive from holding tank 28 then takes place at mixing means 27 and the mixing of the additive from holding tank 33 then takes place at mixing means 48 since valves 22 and 36 are closed. Other embodiments of the process of producing odorized gas of our invention may be utilized using the apparatus of FIG. 1 in various configurations where, for example, premixing of odorants 14 and 28 may occur at mixing means 32 and mixing of odorant from holding tank 33 may occur at mixing vessel 48 with previously-odorized hydrocarbon gas.

Figure 2:
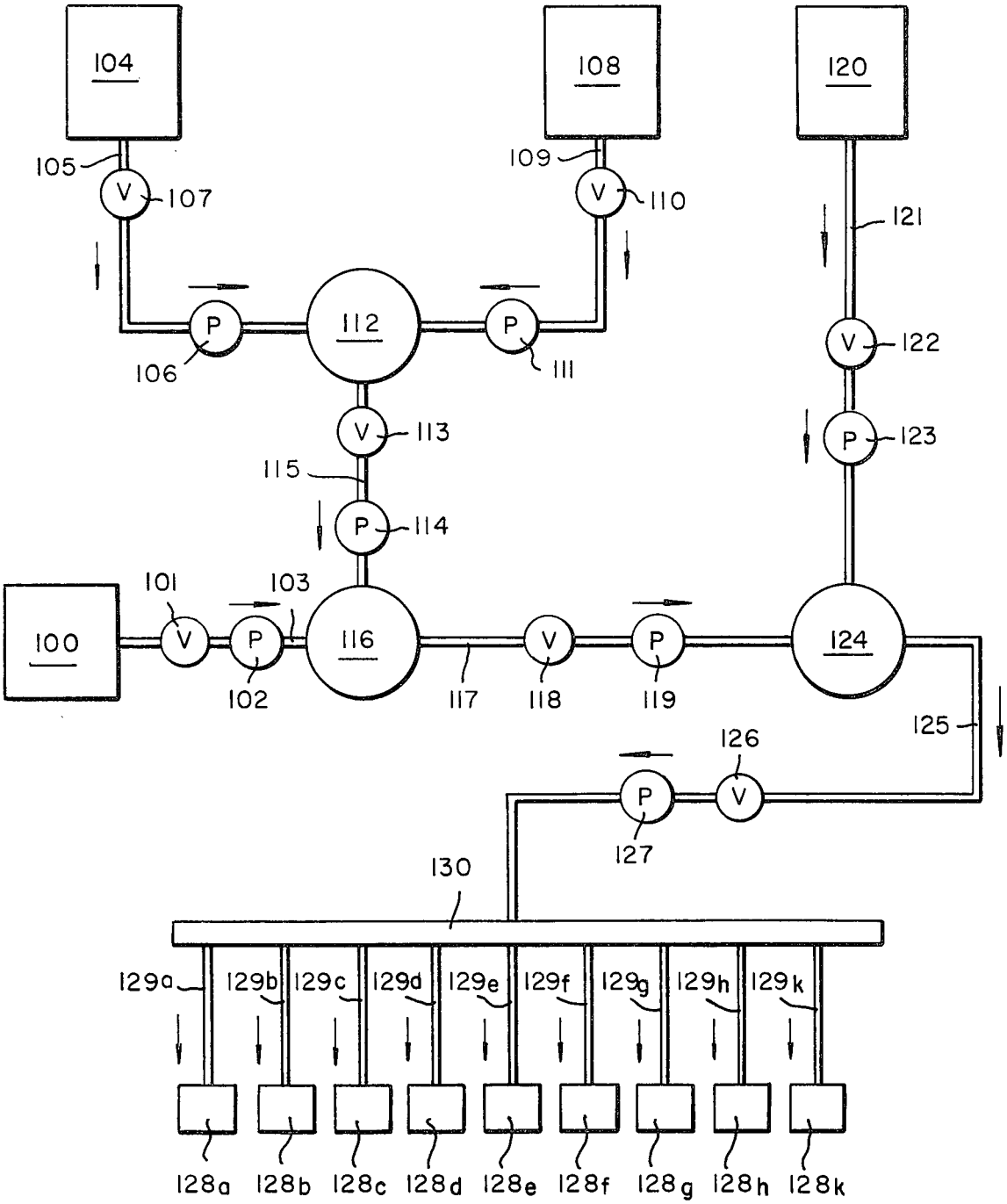
FIG. 2 is another embodiment showing the formation of the odorant mixtures of our invention and subsequent mixture with the hydrocarbon gas stream and subsequent distribution of hydrocarbon gases.

An alternative embodiment of the apparatus of FIG. 1 is that set forth in schematic form in FIG. 2. In FIG. 2, hydrocarbon gas such as propane, from holding tank 100 is passed through line 103 using pump 102 through control valve 101 into mixing means 116 where it is premixed with odorant 4-methyl-4-mercapto-2-pentanone from source (holding tank) 104 and odorant 2-methoxy-3-isobutyl pyrazine from holding tank 108 which are premixed at mixing means 112. Thus, odorant from holding tank 104 is passed through line 105 using pump 106 through control valve 107 into mixing means 112 while simultaneously odorant from holding tank 108 is passed through line 109 through valve 110 using pump 111 into mixing means 112. The premixed odorant mixture containing 4-methyl-4-mercapto-2-pentanone and 2-methoxy-3-isobutyl pyrazine in various proportions is controlled using control valves 107 and 110 is then passed through line 115 through control 113 using pump 114 into mixing means 116 where it is premixed with the hydrocarbon gas coming from vessel 100. The resulting odorant-hydrocarbon gas mixture may, if desired, be further mixed with additional odorant, e.g. cyclohexyl mercaptan, held in tank 120 which is passed through line 121 using control valve 122 and pump 123 into mixing means 124 where it is mixed with previously-odorized hydrocarbon gas which has been passed through line 117 using control valve 118 and pump 119 into mixing means 124. The resulting mixture is then passed through line 125 using control valve 126 and pump 127 into manifold 130 where it is then distributed through distribution lines 129*a*, 129*b*, 129*c*, 129*d*, 129*e*, 129*f*, 129*g*, 129*h* and 129*k* into distribution points or blocks 128*a*, 128*b*, 128*c*, 128*d*, 128*e*, 128*f*, 128*g*, 128*h* and 128*k*.

The amount of odorant desired in each of the distribution points may be controlled using electronic programming controllers which feed back the desired amount of odorant at each of the distribution points to a program which controls valves 107, 110, 113, 101, 118 and 122.

Figure 3:
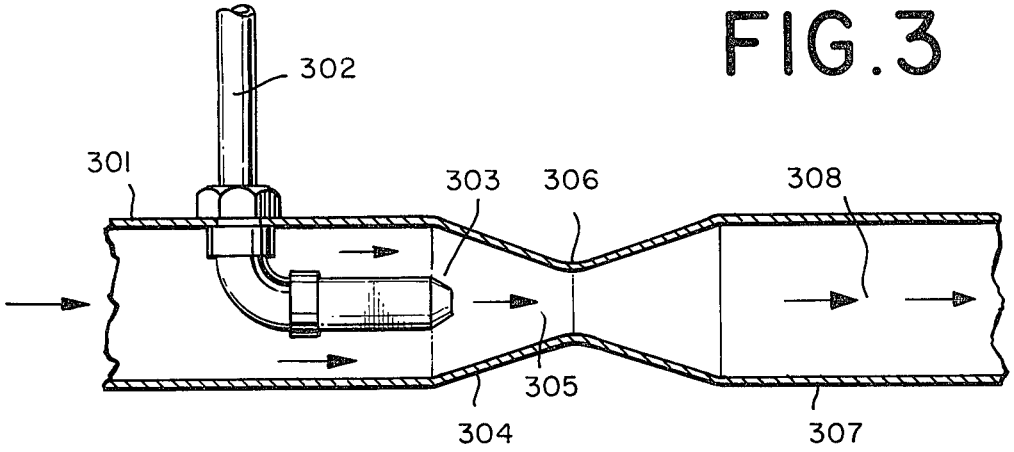
FIG. 3 is a cross section of a "Venturi" mixing apparatus section where the odorant mixture of our invention is admixed with the hydrocarbon gas stream to form an odorized gas.
Figure 4:
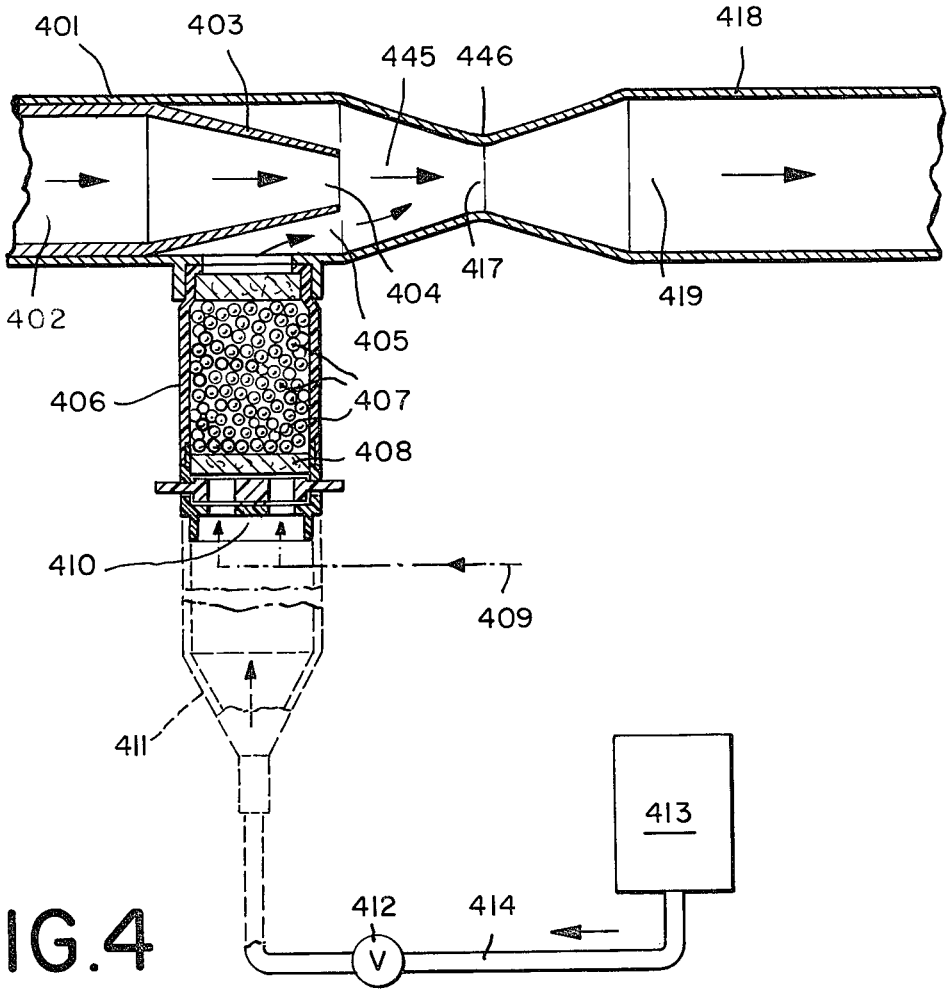
FIG. 4 is an embodiment of the apparatus of FIG. 3 wherein the odorant gas is included in or on polymeric particles and air or nitrogen or another gas contacting the polymeric particles picks up odorant from the polymeric particles and the resulting gas mixture is admixed with a hydrocarbon gas stream.

FIGS. 3 and 4 show alternative embodiments of mixing apparatus in detail. FIG. 3 sets forth a schematic diagram of a Venturi mixing line where odorant passes through line 302 and is mixed with hydrocarbon gas being passed through line 301 at the Venturi throat 306. The mixing of the hydrocarbon gas coming through 301 actually occurs at location 305 where the Venturi throat 306 is beginning to constrict at location 304. Thus, odorant, e.g. 50—50 mixture of 4-methyl-4-mercapto-2-pentanone and 2-methoxy-3-isobutyl pyrazine passes through line 302 and emanates at location 303 into the gas stream where mixing takes place at about location 305. The resulting odorized gas then passes through line 307 in admixture at location 308.

In the alternative, the odorants 4-methyl-4-mercapto-2-pentanone and 2-methoxy-3-isobutyl pyrazine or 2-methoxy-3-isobutyl pyrazine alone or 4-methyl-4-mercapto-2-pentanone alone may be adsorbed on polymeric pellets 407 as is shown in the cut-away diagram of FIG. 4. Thus as hydrocarbon gas such as propane passes through duct 401 at location 402, it is then constricted at 403 and mixed with additive just prior to the Venturi throat 416 at location 415. The gas passes through nozzle 403 through opening 404 and the additive odorant is conveyed through duct 405 as air or nitrogen or additional odorant (in the alternative or in combination) is conveyed from location 413 through line 414 past control valve 412 through line 411 into polymeric odorant holding device 406. The passage of the air is shown by reference numeral 409. Additional odorant, e.g. 1,2-ethane dimercaptan would be located (optionally) at location 413. Polymeric particles having adsorbed thereon odorant as shown by the reference numeral 407 may be produced by any well known means in the art, for example, that disclosed in application for U.S. Pat. Ser. No. 507,292 filed on June 23, 1983 now abandoned, the disclosure of which is incorporated by reference herein.

What is claimed is:

1. A warning agent suitable for the odorization of gaseous hydrocarbon fuel, said agent selected from the group consisting of (i) 4-methyl-4-mercapto-2-pentanone, (ii) 2-methoxy-3-isobutyl pyrazine and (iii), mixtures of same in addition, a gas odorant selected from the group consisting of monomercaptans, acyclic and cyclic sulfides and mixtures of same.

2. A warning agent defined according to claim 1 wherein the gas odorant is thiophane.

3. A warning agent defined according to claim 1 wherein the gas odorant is a mixture of $C_2$–$C_4$ aliphatic monomercaptans having a boiling range of about 100°–215° F.

4. A warning agent defined according to claim 1 wherein the gas odorant is a mixture of low molecular weight sulfides.

5. A warning agent as defined according to claim 1 wherein the gas odorant is dimethyl sulfide.

6. A warning agent defined according to claim 5 wherein there is present in addition a minor amount of $C_2$–$C_4$ monomercaptans having a boiling range of about 100°–215° F.

7. A process for the odorization of a hydrocarbon fuel gas which comprises incorporating in said gas an effective odorizing quantity of a warning mixture (i) a substance selected from the group consisting of 4-methyl-4-mercapto-2-pentanone, 2-methoxy-3-isobutyl pyrazine and mixtures of same and (ii) a gas odorant selected from the group consisting of monomercaptans, acyclic sulfides, cyclic sulfides and mixtures of same.

8. A process according to claim 7 wherein the gas odorant is thiophane.

9. A process according to claim 7 wherein the gas odorant is a mixture of $C_2$–$C_4$ aliphatic monomercaptans having a boiling range of about 100°–215° F.

10. A process according to claim 7 wherein the gas odorant is a mixture of low molecular weight sulfides and a minor amount of $C_2$–$C_4$ monomercaptans having a boiling range of about 100°–215° F.

11. A process according to claim 7 wherein the gas odorant is a mixture comprising dimethyl sulfide and a minor amount of $C_2$–$C_4$ monomercaptans having a boiling range of about 100°–215° F.

* * * * *